US005934786A

United States Patent [19]

O'Keefe

[11] Patent Number: 5,934,786

[45] Date of Patent: Aug. 10, 1999

[54] SEALED LIGHTING UNIT FOR CLEAN-ROOMS AND THE LIKE

[76] Inventor: Donald L. O'Keefe, 1800 52nd St. SW., Wyoming, Mich. 49509

[21] Appl. No.: 08/531,666

[22] Filed: Sep. 21, 1995

[51] Int. Cl.[6] ..... F21V 31/02

[52] U.S. Cl. ..... 362/147; 362/218; 362/267; 362/365

[58] Field of Search ..... 362/147, 148, 362/149, 150, 218, 219, 267, 365, 217, 227; 52/506.06, 506.08

[56] References Cited

U.S. PATENT DOCUMENTS

| | | | |
|---|---|---|---|
| 2,327,552 | 8/1943 | Poehling | 362/227 |
| 2,873,358 | 2/1959 | Dunker | 362/267 |
| 3,015,721 | 1/1962 | Guth, Jr. | 362/217 |
| 3,281,587 | 10/1966 | Quin | 362/227 |
| 3,555,267 | 1/1971 | Sutter | 362/150 |
| 3,570,385 | 3/1971 | Heisterkamp | 362/150 |
| 3,838,268 | 9/1974 | Fabbri | 362/218 |
| 3,860,829 | 1/1975 | Fabbri | 362/218 |
| 4,171,535 | 10/1979 | Westerman | 362/148 |
| 4,188,656 | 2/1980 | Howard | 362/365 |
| 4,410,931 | 10/1983 | DeCandia et al. | 362/267 |
| 4,461,205 | 7/1984 | Shuler | 362/218 |
| 4,494,175 | 1/1985 | Gawad et al. | 362/365 |
| 4,580,200 | 4/1986 | Hess et al. | 362/267 |
| 4,625,267 | 11/1986 | Mikalonis | 362/150 |
| 4,671,811 | 6/1987 | Cadwell, Jr. et al. | 52/506.06 |
| 4,860,180 | 8/1989 | Degelman | 362/150 |
| 4,883,513 | 11/1989 | Monson et al. | 52/506.06 |
| 4,967,530 | 11/1990 | Clunn | 52/506.08 |
| 5,161,878 | 11/1992 | Degelmann et al. | 362/150 |
| 5,279,632 | 1/1994 | Decker et al. | 52/506.06 |

FOREIGN PATENT DOCUMENTS

| | | | |
|---|---|---|---|
| 2704302 | 10/1994 | France | 362/147 |
| 1489335 | 4/1969 | Germany | 362/147 |
| 2943544 | 5/1981 | Germany | 362/147 |
| 1112425 | 5/1968 | United Kingdom | 362/218 |

*Primary Examiner*—Y. Quach
*Attorney, Agent, or Firm*—Price, Heneveld, Cooper, DeWitt & Litton

[57] ABSTRACT

A lighting unit adapted to provide a sealed closure in an opening in a Clean-Room ceiling includes a housing which supports one or more light emitting means and has a perimeter structure for supporting the housing in place over the ceiling opening, and a substantially impermeable light diffuser sealingly mounted to the housing by a peripheral frame. A perimeter gasket is retained between and sealingly engages perimeter surfaces of the frame and the opening in the ceiling, and a reversibly adjustable retention device supports the frame and housing together to cause the gasket to sealingly engage the perimeter surface of the frame and the opening in the ceiling. The lighting unit is adapted to prevent or abate leakage of filtered, conditioned air from a room, e.g., a Clean-Room, and is adapted to prevent or abate infiltration of unfiltered, contaminated air into the room from the space above the ceiling.

14 Claims, 1 Drawing Sheet

CONVENTIONAL LIGHT HOUSING W/UNSEALED SEAMS

SEALED LIGHTING UNIT FOR CLEAN-ROOMS AND THE LIKE

This invention relates to sealed lighting units for use in drop-type ceilings in Clean-Rooms. More specifically, this invention provides an improved method for making sealed lighting units for drop-ceilings, and a novel sealed lighting unit structure for drop-ceilings, having a simplified, light-weight design which provides an effective seal between the lighting unit and the opening in the drop-ceiling which retains the light fixture, so that the Clean-Room below the drop-ceiling is isolated from dust or other contaminants which may be present in the space above the drop-ceiling.

BACKGROUND OF THE INVENTION

Certain types of equipment, and manufacturing processes, analytical chemistry techniques and other similar operations can be adversely affected in the presence of air containing even normal levels of dust and other airborne particulate matter. Accordingly, dust-sensitive equipment and processes are generally maintained or conducted in a controlled environment which is provided with filtered air from which all or most particulate material above a predetermined minimum size has been removed. Such controlled environments wherein reduced particulate levels are maintained are commonly referred to as "Clean-Rooms". Filtered, conditioned air is generally supplied to the Clean-Room at a rate which is sufficient to maintain a substantially continuous positive pressure (i.e., above ambient pressure) in the Clean-Room so that any leakage of air between the Clean-Room and its surroundings occurs outwardly from the Clean-Room. To minimize the cost of supplying filtered, conditioned (e.g., heated, cooled, humidified, dehumidified, etc.) air to a Clean-Room at a pressure and rate which is sufficient to maintain a positive pressure in the Clean-Room and to prevent infiltration of ambient particulate-laden air into the Clean-Room, it is highly desirable to eliminate nonessential openings which allow filtered, conditioned air to escape from the Clean-Room or which could allow particulate-laden air to enter. It is also desirable to maintain good seals around any essential or desired openings such as doors, windows, and passageways for electrical conduits, plumbing, etc.

Drop-ceilings are often used in Clean-Rooms for aesthetic and practical reasons, such as to conceal conduit, piping, ductwork, etc., to eliminate the need to maintain air-tight seals at openings through which conduit, piping, ductwork and the like would otherwise enter the Clean-Room and to reduce the volume of air which must be pumped and filtered to maintain the desired particle-free environment. In order to minimize leakage from the Clean-Room and provide improved isolation of the Clean-Room from particulate-laden air in the surrounding environment, specially designed sealed lighting units are used for Clean-Room drop-ceilings. Known types of such sealed lighting units are much more expensive than ordinary drop-ceiling lighting units because the sealed lighting units are designed to have a completely sealed outer housing. This places the light-emitting means (e.g., fluorescent bulbs) inside the filtered atmosphere of the Clean-Room, and allows for replacement of the light-emitting means without exposing the Clean-Room to contamination from the outside, but this is an incidental benefit and the main goal is to merely maintain a continuous wall between the inside of the Clean-Room and the outside.

Housings for conventional Clean-Room drop-ceiling lighting units are generally formed from sheet metal by conventional cutting and bending operations, as are ordinary or general purpose drop-ceiling lighting units. However, unlike ordinary lighting units, the adjacent sidewall edges of housings for sealed Clean-Room drop-ceiling lighting units are seam-welded at all points to provide fluid-tight corners, which are subsequently ground smooth for aesthetic and safety reasons. These additional operations add a great deal to the production costs of conventional Clean-Room drop-ceiling lighting units as compared with ordinary lighting units wherein the corners are not fluid-tight. The additional expense associated with the seam-welded corners on the housings of conventional Clean-Room drop-ceiling lighting units has heretofore been generally regarded as necessary and unavoidable to reduce air leakage from the Clean-Room and to ensure that particulate contaminants present in the space above the drop-ceiling do not enter into the Clean-Room through the lighting units.

SUMMARY OF THE INVENTION

The present invention provides a simple, inexpensive but highly effective method of providing sealed drop-ceiling lighting units for use in a Clean-Room, by which leakage of filtered, conditioned air through and around the lighting unit and infiltration of particulate-contaminated air into the Clean-Room from the space above the drop-ceiling are abated. The invention also provides simple, inexpensive lighting units, for a drop-ceiling in a Clean-Room, which prevent air leakage and infiltration of particulate-laden air.

In accordance with the invention, it has been discovered that the foregoing benefits can be achieved without employing lighting units having a sealed outer housing which maintain the light-emitting means in the filtered atmosphere of the Clean-Room. This is accomplished by employing a continuous, substantially impermeable lens or light diffuser, providing a first perimeter seal between the lighting unit frame and the impermeable lens/diffuser, and providing a second perimeter seal between the lighting unit frame and the ceiling support grid members. The basic concept of the invention is to provide a continuous, sealed closure disposed generally between the ceiling support grid and an impermeable light-diffuser which is sealingly encased within a frame, as opposed to the conventional practice of providing closure between the support grid and the lighting unit housing. Therefore, the invention excludes the space between the lighting unit housing and the light diffuser from the controlled atmosphere of the Clean-Room, whereby the need for a closed housing having welded or other sealed seams is eliminated.

The principles of the invention can be used to adapt ordinary conventional drop-ceiling lighting unit for use in a Clean-Room in a manner whereby both air leakage from the Clean-Room through or around the lighting unit and entry of particulate contaminants into the Clean-Room from the space above the drop-ceiling are substantially precluded.

These and other features, objects, and benefits of the invention will be recognized by those who practice the invention and by those skilled in the art, from the specification, the claims, and the drawing figures.

DESCRIPTION OF THE PREFERRED EMBODIMENTS

Figure 1:
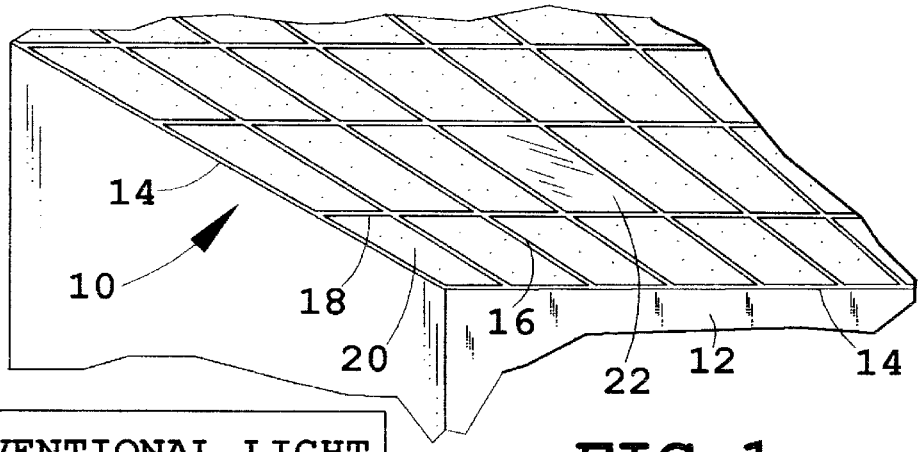
FIG. 1 is a fragmentary perspective view of a Clean-Room drop-ceiling having a lighting unit which is adapted to abate leakage of filtered air from a Clean-Room and particulate contamination from the space above the drop-ceiling.

Referring to FIG. 1, there is shown a typical drop-ceiling 10 as used in a Clean-Room 12. The drop-ceiling 10 serves as a barrier which separates the filtered air inside the Clean-Room 12 from the space above the drop-ceiling, which is typically occupied by unfiltered air which may contain relatively high particulate levels as compared with the air inside the Clean-Room. The drop-ceiling 10 includes a grid support system comprising angle members 14 having an L-shaped transverse cross section and which are attached in a conventional manner to the walls 15 of the Clean-Room, a plurality of longitudinal grid support members 16 having a T-shaped cross section, and a plurality of transverse grid support members 18 having a T-shaped cross section. The ceiling support members are interconnected and supported in a conventional manner to form a lattice-like structure for supporting ceiling tiles 20 and lighting units 22. The ceiling tiles 20 used in Clean-Rooms are typically continuous, substantially impermeable sheets having edge gaskets which engage the grid flanges 21 or which are otherwise adapted to be sealingly engaged along the perimeter thereof to the horizontal grid flanges 21 of the support members 14, 16, and 18. Suitable grid support systems and ceiling tiles for use in maintaining an adequate barrier which inhibits leakage of filtered air from the Clean-Room 12 into the space above the drop-ceiling 10 and which restricts infiltration of unfiltered, particulate-laden air into the Clean-Room from the space above the drop-ceiling are well known and do not in and of themselves constitute elements of the invention.

Figure 2:
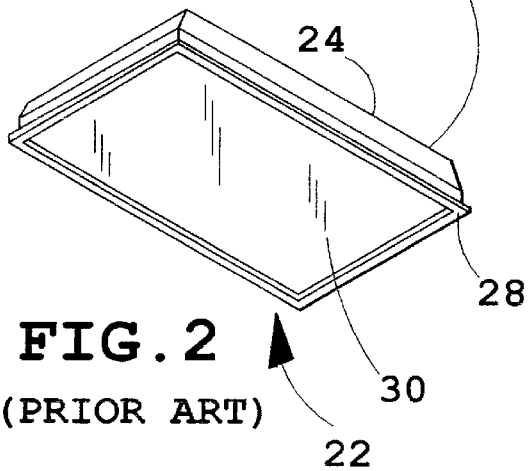
FIG. 2 (PRIOR ART)
FIG. 2 is a bottom perspective view of a typical drop-ceiling lighting unit.
Figure 3:
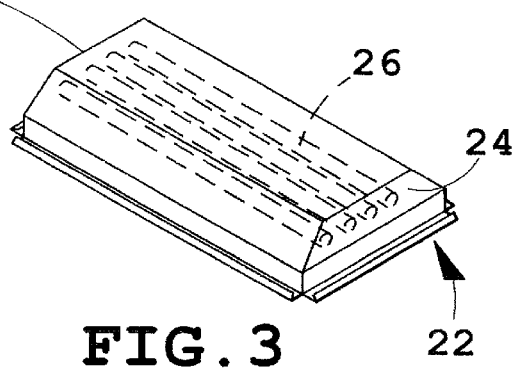
FIG. 3 (PRIOR ART)
FIG. 3 is a top perspective view of the drop-ceiling lighting unit shown in FIG. 2.

A lighting unit 22 which, in accordance with the principles of the invention, is adapted to be mounted into one of the openings of the grid support structure is generally shown in FIGS. 2 and 3. The lighting unit 22 includes a housing 24 which contains and supports light-emitting means 26 (typically conventional tubular fluorescent bulbs), and associated electrical means (not shown) of a conventional nature for supplying electrical current to the light-emitting means to provide illumination therefrom. The housing 24 can be, and preferably is, basically of a conventional overall design. Specifically, the invention does not require a housing having welded or otherwise-sealed seams. Instead, the lighting unit 22 includes a special light-diffuser frame 28 which cooperates with the housing 24 (which may be a conventional type not ordinarily used in Clean-Rooms) to provide sealing engagement between the frame 28 and the adjacent horizontal grid flanges 21 supporting the lighting unit. A continuous, substantially impermeable lens or light-diffuser 30 having special characteristics is closed within the diffuser frame 28. The light-diffuser 30 can be made of generally any impermeable, light-transmitting material such as plastic or glass, including transparent, translucent, clear, cloudy, tinted, and colored solid materials. Suitable substantially impermeable materials include any of those which serve as effective barriers against transfer of air. The frame 28 is made of a continuous, substantially impermeable material, e.g., extruded aluminum.

Figure 4:
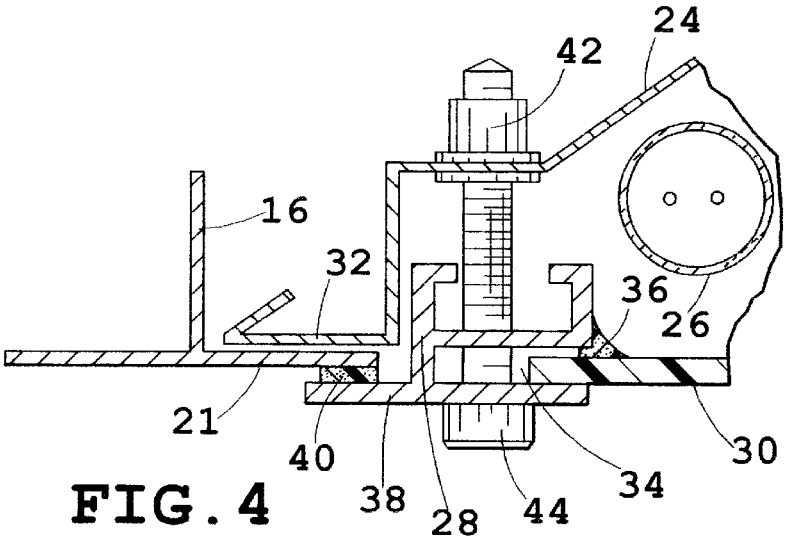
FIG. 4 is a fragmentary elevational, cross-sectional view of a drop-ceiling showing a grid support member supporting portions of a lighting unit, illustrating a preferred embodiment of the invention.

A particular embodiment of means for mounting the lighting unit 22 on the grid support system (comprising members 14, 16, and 18) and for providing a relatively simple sealed closure of the opening in the grid support system in which the lighting unit has been mounted are shown in FIG. 4. The housing 24 of lighting unit 22 has a horizontally projecting perimetral flange 32, which provides means for supporting the housing on the horizontal grid flanges 21. The perimetral frame 28 of lighting unit 22 includes an inwardly facing perimeter channel 34 which receives and closes the edges of the continuous, imperforate light-diffuser panel or lens 30. A perimeter seal 36 is provided between the light-diffuser panel 30 and the frame 28, so that the frame and light diffuser panel act as a single continuous, substantially impermeable barrier against air flow. That is, the seal 36 prevents air from leaking around the edges of diffuser panel 30, through the perimeter channel 34. While the seal 36 is shown at the upper surface of the light diffuser 30 (i.e., the surface facing the housing), it should be understood that this seal can be located elsewhere, e.g., completely within the channel 34 or on the lower surface of the light diffuser 30, so long as a continuous perimeter seal is provided between the frame 28 and the light diffuser. Seal 36 can be of any suitable material customarily used to provide an air-tight joint between solid surfaces of a structure. For example, various commercially available silicone sealant compositions can be used to form the seal 36.

The diffuser frame 28 has an outwardly projecting horizontal perimeter flange 38 which is parallel with and underlies the grid flange 21 when the lighting unit 22 is assembled, as shown in FIG. 4. A perimeter gasket 40 is disposed between the upper surface of the flange 38 and the lower surface of the grid flange 21 to provide a continuous perimeter seal between the frame 38 and the adjacent surrounding grid support members 14, 16, and 18 when the flanges 32 and 38 are urged together with the flange 21 disposed therebetween. The gasket 40 can be retained between flanges 21 and 38 by compression only, but for convenience during installation and to avoid inadvertent displacement of the gasket prior to (or during) installation, the gasket 40 is preferably affixed to the upper surface of the flange 38 by means such as a sealing adhesive composition, e.g., silicone jell. The gasket 40 can be formed of any of various materials known to be suitable for providing an air seal between structural surfaces. Examples of suitable materials for forming the gasket 40 include various resilient elastomeric polymers such as neoprene, chloroprene, and polybutalene.

A captive internally threaded fastener 42 secured in an opening in the housing 24 receives with a thumbscrew 44 or the like passing upwardly through a threaded opening in the frame 28 to secure the frame 28 in place upon the housing 24 and to provide means for urging flanges 32 and 38 together with the flange 21 and gasket 38 interposed therebetween, whereby the lighting unit 22 provides a continuous sealed closure of the opening of the grid support system in which the lighting unit is mounted. Various means for removably mounting the frame 28 in place and holding it and the housing 24 together to effect an air-tight seal between the frame and the flange 21 of the support members 14, 16, and 18 will be readily apparent to those having ordinary skill in the art and fall within the spirit and scope of the invention.

The lighting unit 22 is prepared for use in a Clean-Room drop-ceiling by closing a continuous, substantially impermeable light-diffuser panel within a peripheral frame; sealing around the perimeter between the frame and the light-diffuser; providing a lighting unit housing which supports and contains one or more light-emitting means and associated electrical means for supplying electrical current to the light emitting means, and which includes means for supporting the housing in an opening of a drop-ceiling grid support system; providing a perimeter gasket adapted to be retained between and sealingly engage perimeter surfaces of the frame and the opening in the grid support system; and providing means for supporting the frame from the housing and urging the frame and the housing together to cause the perimeter gasket to sealingly engage perimeter surfaces of the frame and the opening in the grid support system to achieve a continuous sealed closure of the opening in the grid system.

It is to be particularly noted in conjunction with the foregoing that while the housing 24 and associated lighting means may generally be of the type found in standard off-the-shelf unsealed lighting fixtures of the type conventionally used for general office or other such applications (not including Clean-Room applications), and while some such standard lighting fixtures do or may use imperforate sheet-type lenses, such standard units could not be used directly in Clean-Room applications as customarily known and configured, since the ceiling grid structures of Clean-Rooms are wider than those of conventional office-type or residential drop ceilings and they would therefore extend under the lens members or all four sides, blocking them and making them non-removable (unless the entire fixture was to be removed and disassembled). Thus, it would be impossible as a practical matter to replace lighting tubes or otherwise service such a unit after it was once installed, since it would not only be unduly expensive but it would also probably introduce unacceptable levels of contaminants into the Clean-Room environment each time a light had to be serviced. This problem is solved in a simple and effective manner in accordance with the invention by merely making the lens 30 in a special and non-standard size, and sizing the frame 28 appropriately, so that removal of the lens (and frame) may be accomplished in the easy and effective manner described above.

It will be understood by those who practice the invention and by those skilled in the art that various modifications may be made to the preferred embodiment shown and described herein for illustration without departing from the spirit of and concept underlying the invention. The scope of protection afforded is therefore not to be determined by the particular structure shown but by the claims and by the breadth of interpretation thereof allowed by law.

The embodiments of the invention in which an exclusive property or privilege is claimed are defined as follows:

1. A lighting unit for use in the ceiling of a Clean-Room to provide a sealed closure for an opening in said ceiling, comprising:

a housing which at least partially encloses and supports one or more light-emitting elements, said housing having an upper extremity which includes unsealed seams through which ambient air above said ceiling may communicate, and a lower extremity defining an opening which affords access to said light-emitting elements and through which said elements emit light into said Clean-Room;

a perimetral frame extending around said opening defined by said lower extremity of said housing, said frame disposed in alignment with said housing lower extremity and with the opening in said ceiling a substantially imperforate light diffuser having a size and shape generally corresponding to said opening defined by said housing lower extremity and disposed over said housing lower extremity opening to cover said housing lower extremity opening, said perimetral frame having first portions extending under said diffuser to mount said diffuser in place over said housing lower extremity opening and also having second portions defining a perimeter larger than said ceiling opening to underlie said ceiling around said opening;

a perimeter seal extending around and operatively disposed between adjacent surfaces of said perimetral frame first portions and said light diffuser, and a perimeter gasket adapted to extend between and sealingly engage said ceiling and at least one of said second portions of said perimetral frame and said housing around the ceiling opening; and a releasable fastener for holding said perimetral frame, said light diffuser and said housing together with said perimeter gasket compressively clamped in sealing disposition against said ceiling, whereby said lighting unit provides a continuous peripherally sealed closure of the opening in said ceiling which is releasable for ready access to said light-emitting elements.

2. The lighting unit of claim 1, wherein said housing includes an outwardly projecting flange extending around the perimeter of and away from said housing lower extremity opening.

3. The lighting unit of claim 1, wherein said light diffuser is held by and peripheral enclosed within said perimetral frame.

4. The lighting unit of claim 3, wherein said light diffuser is sealingly disposed in said perimetral frame by a continuous perimeter seal between said frame and said light diffuser, whereby said frame and said light diffuser act together as a continuous, substantially imperforate barrier against air flow.

5. The lighting unit of claim 3, wherein said perimetral frame second portions include an outwardly projecting perimeter flange which is adapted to overlie perimetral edges of said ceiling opening with said perimeter gasket disposed in sealing engagement therebetween.

6. The lighting unit of claim 5, wherein said perimeter gasket is affixed to said perimeter flange of said perimetral frame.

7. The lighting unit of claim 5, wherein said releasable fastener for holding said frame and said diffuser and housing together comprises an internally threaded receptacle secured to said housing and a threaded member passing through said perimetral frame, said threaded member being adapted to threadedly engage the internal threads of said receptacle and thereby provide a variable clamp between said perimeter frame and said housing.

8. A method of mounting a lighting unit in a ceiling opening having a perimeter and perimeter edges, to provide a sealed closure for said ceiling opening, comprising:

using a lighting unit having a housing with at least some unsealed seams allowing air passage therethrough and a generally open bottom defining a perimeter, said housing adapted to support one or more light-emitting elements and having a support flange extending around said perimeter of said housing open bottom;

disposing said lighting unit within said ceiling opening, placing a continuous, substantially imperforate light-diffuser over and substantially covering said open bottom of said housing, and sealing said perimeter of said housing open bottom and said light-diffuser with respect to one another;

disposing a perimetral frame around said perimeter of said ceiling opening, and placing a perimeter gasket between and in sealing engagement with adjacent surfaces of said perimetral frame and the perimeter edges of the ceiling opening; and securing said housing to said perimetral frame with said ceiling perimeter edges clamped between said support flange of said housing and a portion of said perimetral frame, and with said perimeter gasket clamped in sealing engagement between said ceiling perimeter edges and at least one of housing support flange and said portion of said frame.

9. A method according to claim 8, wherein said support flange of said housing comprises an outwardly projecting member extending generally around said perimeter of said housing open bottom.

10. A method according to claim 9, wherein said perimetral frame is sized to overlie the perimeter edges of said ceiling opening and is used to provide a perimetral surface for supporting said perimeter gasket in sealing engagement with the perimeter edges of said ceiling opening.

11. A method according to claim 8, wherein said light diffuser is mounted with its perimeter overlying at least portions of said perimetral frame.

12. A method according to claim 11, including the step of using a continuous perimeter seal between said perimetral frame and said light diffuser, whereby said perimetral frame and said light-diffuser act as a continuous, substantially imperforate barrier against air flow.

13. A method according to claim 8, including the step of attaching said perimeter gasket to said perimetral frame.

14. A method according to claim 8, wherein said step of securing said housing to said perimetral frame comprises clamping said perimetral frame in place over the perimeter edges of said ceiling opening with said perimeter gasket compressively disposed therebetween.

* * * * *